US005178420A

United States Patent [19]

Shelby

[11] Patent Number: 5,178,420

[45] Date of Patent: Jan. 12, 1993

[54] REUSABLE FACSIMILE TRANSMITTAL SHEET AND METHOD

[76] Inventor: Meredith E. Shelby, 18905 Roselawn Ave., Detroit, Mich. 48221

[21] Appl. No.: 853,832

[22] Filed: Mar. 19, 1992

[51] Int. Cl.[5] ..... B42D 15/00

[52] U.S. Cl. ..... 283/94; 283/72

[58] Field of Search ..... 283/72, 67, 94, 100, 283/101; 355/133, 40; 354/292; 281/21.1

[56] References Cited

U.S. PATENT DOCUMENTS

| | | | |
|---|---|---|---|
| 3,794,550 | 8/1972 | Taillie | 161/147 |
| 4,334,771 | 6/1982 | Ryan, Jr. | 355/133 |
| 4,511,161 | 4/1985 | Gruner | 283/1 A |

FOREIGN PATENT DOCUMENTS

| | | | |
|---|---|---|---|
| 9003277 | 4/1990 | World Int. Prop. O. | 283/94 |

*Primary Examiner*—Timothy V. Eley
*Assistant Examiner*—Willmon Fridie, Jr.
*Attorney, Agent, or Firm*—Dykema Gossett

[57] ABSTRACT

A reuseable facsimile transmittal sheet assembly includes a base sheet of a white opaque plastic material, with indicia imprinted thereon to identify sender by name, address, phone and facsimile numbers, sender, I.D., time and date. The sheet is adapted for application thereto of a manually erasable message. A clear plastic overlay sheet is protectively positioned and adhesively retained over the base sheet and the assembly is inserted into a facsimile machine. The method further includes lifting the clear plastic sheet exposing the message and wiping over the base sheet removing the message therefrom, the base sheet being adapted to receive successive messages, one at a time.

1 Claim, 1 Drawing Sheet

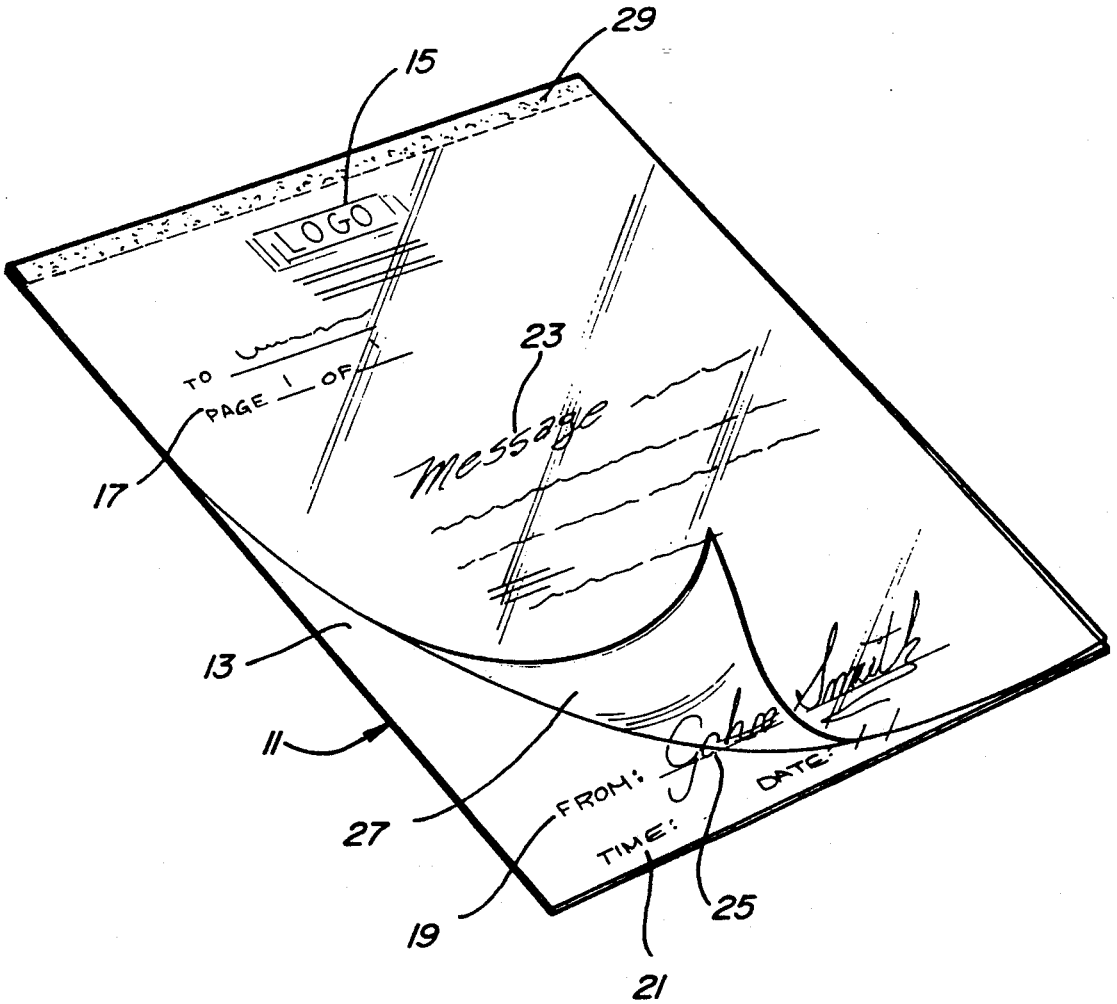
29
15
LOGO
TO
PAGE 1 OF
23
Message
17
13
11
27
FROM:
DATE:
TIME:
19
25
21

REUSABLE FACSIMILE TRANSMITTAL SHEET AND METHOD

FIELD OF THE INVENTION

Relates to facsimile transmittals and more particularly to a reuseable facsimile transmittal sheet assembly and method of use.

BACKGROUND OF THE INVENTION

Usually in the use of facsimile machines a transmittal sheet is considered a throw away item once used. Multiply this thousands of times in any office and in the thousands of offices throughout the country and you arrive at a considerable waste if there is a basis by which facsimile transmittal sheet could be reused for further and subsequent transmittals. Previously in the use of facsimile transmittal sheets for a particular company the storage of such sheets usually includes printed thereon company name, address, phone and facsimile numbers, usually indicia as to the number of pages of the transmission and a salutary phrase for fill in, directed to the person to whom the message is sent. At the bottom and printed upon the sheet is an indication for a fill in line of the person sending the message as well as the time and date of the message for fill in upon the sheet.

The sheets have in common a central message receiving area which may vary message to message. It is common practice after the sending of the message to discard the single use facsimile transmittal sheet.

THE PRIOR ART

Examples of related prior art involving a transparent sheet or sheet bindings are set forth in one or more of the following United States patents:

| PATENT NO. | DATE | INVENTOR |
|---|---|---|
| 3,794,550 | February 26, 1974 | G. P. Taillie Sheet Binding |
| 4,334,771 | June 15, 1982 | Leroy J. Ryan, Jr. Visually Descriptive Information Transmission Storage and Retrieval Set |
| 4,511,161 | April 16, 1985 | John Gruner Identification and Control Apparatus for example, for service personnel for a restaurant. |

SUMMARY OF THE INVENTION

An important feature of the present invention is to provide a reuseable facsimile transmittal sheet assembly.

Another feature is to provide a reuseable facsimile transmittal sheet assembly which includes a base sheet of a white opaque plastic material with indicia imprinted thereon to identify the sender by name, address, phone and facsimile numbers, sender I.D. time and date. The sheet is adapted for application of a manually erasable message. A clear plastic overlay sheet is protectively positioned and adhesively retained over the base sheet and the assembly is inserted into a facsimile machine for transmittal of the message electronically.

A further feature is to provide a method which additionally includes lifting the clear plastic sheet exposing the message and wiping over the base sheet with a cloth, removing the message therefrom, the base sheet being adapted to receive successive messages, one at a time.

Another feature is to provide as the base sheet a sheet of white opaque plastic material with suitable indicia imprinted thereon for repeated use and with a sheet adapted for application thereto of a manually erasable message by the use of a China marker or water based marker.

A further feature is to include upon the undersurface of the overlay clear plastic top sheet an adhesive strip on one of the edges thereof, preferably the top edge in order to retain the overlay clear plastic sheet over the base sheet during the sending process and for the purpose of protecting the machine against contamination by the substance of the marking device and to protect the message from distortion.

A further feature is the method of using a reuseable facsimile sheet assembly which comprises providing a reusable base sheet of a white opaque plastic material which has imprinted thereon indicia to identify the sender by name, address, phone and facsimile numbers, sender identification time and date, applying to the base sheet an erasable message and thereafter apply a clear plastic sheet over and protectively positioned and removably adhered upon the base sheet adjacent one edge thereof; thereafter sending a facsimile message and successively lifting the clear plastic sheet or folding it back exposing the message and applying a wiping cloth over the surface of the base sheet removing said message therefrom, the said base sheet adapted to receive successive messages, one at a time.

These and other features and objects will be seen from the following specification in conjunction with the appended drawing.

THE DRAWINGS

The figure in the drawing is a front perspective view of the present reuseable facsimile transmittal sheet assembly.

It will be understood that the above drawing illustrates merely a preferred embodiment of the invention and method, and that other embodiments are contemplated within the scope of the claims hereafter set forth.

DETAILED DESCRIPTION OF AN EMBODIMENT OF THE INVENTION

Referring to the drawing the present reusable facsimile transmittal sheet assembly is generally designated at 11 and includes a base white opaque plastic sheet 13 of rectangular shape.

Identification 15 of the sender is imprinted on the base sheet adjacent the top thereof to include name, address, phone number and fax number.

Permanently imprinted upon the base sheet at 17 is a salutation for the receiver followed by a fill in space with a page indication for the number of pages of the message.

Further imprinted upon the base white opaque plastic sheet 13 is the designation at 19 "FROM" with a space adjacent thereto for indicating the name of the sender as at 25 and adjacent thereto the imprint 21 for conventional time and date fill in spaces adjacent thereto. This would be different from message to message as are also the indications as at 17, 21 and 25.

In use, upon the central portion of base sheet 13 there is manually applied the message 23. This is done with a China marker or other erasable marker such as a water based marker. The message normally takes one or possibly several pages.

The present reusable facsimile transmittal sheet assembly 11 further includes a clear plastic overlay sheet 27 of a polystyrene plastic or the like which is adapted to protectively overlie the base white opaque plastic sheet 13. On the undersurface of the clear plastic overlay sheet 27 there is provided an adhesive strip 29 or equivalent short strips or spots adjacent one of the edges thereof such as the top edge. By the use of the adhesive, the clear plastic overlay sheet is positioned over and removably retained upon the base white opaque plastic sheet to protect the message and to protect the facsimile machine during transmission of the message.

As a further step after the message has been sent, the top overlay sheet 27 is rolled back or removed and the message wiped off base sheet 13 with a soft cloth or the like.

The base sheet is then available for a repeat or successive messages one at a time wherein after each message the top plastic sheet is reapplied.

The base white opaque sheet may be made of any suitable plastic material having a top shiny surface such as polystyrene or the like. Such sheet is capable of receiving a China marking pencil of a contrasting color such as black, for illustration, or any other suitable water based marker. Under some conditions the top sheet 27 may be omitted.

The method of use of the present invention includes the steps of:

(1) providing a reusable facsimile sheet assembly comprising providing a base sheet of white opaque plastic material;

(2) imprinting indicia upon said sheet to identify the sender by name, address, phone and facsimile number, sender identification, the time and date;

(3) manually applying an erasable message to said sheet utilizing a China marking pencil or other water based marker of a contrasting color and thereafter;

(4) applying a clear plastic sheet overlay over and protectively positioned and removably mounted upon said base sheet adjacent one edge thereof, applying an adhesive strip upon the undersurface of the clear plastic sheet;

(5) sending a facsimile message and successively lifting said clear plastic sheet exposing said message; and (6) apply a wiping cloth over the surface of said base sheet removing said message therefrom, said base sheet being adapted to receive successive messages thereon, one at a time.

The present invention contemplates the new use of an erasable marker such as a China marking pencil, for illustration as applied to an opaque white plastic sheet 13. Such sheet is in the nature of a reusable facsimile transmittal sheet by which after transmittal of the message, the message can be wiped off the transmittal sheet and the transmittal sheet reused.

This provides an immense and substantial saving in the cost of the otherwise throw away non-reusable conventional transmittal sheets.

Having described my invention reference should now be had to the following claims.

I claim:

1. A reusable facsimile transmittal sheet assembly comprising:

a base sheet of white opaque plastic material;

indicia imprinted upon said sheet to identify a sender by name, address, phone and facsimile numbers, sender identification, time and date;

said sheet adapted for application thereto of a manually erasable message of a contrasting color;

a clear plastic overlay sheet protectively positioned and removably retained upon said base sheet; and adhesive strip means positioned on the underside of said clear plastic overlay sheet for allowing said clear plastic overlay sheet to be selectively moved from a first position in which said overly sheet is retained upon said base sheet to a second position in which said overlay sheet is removed from said base sheet and for allowing said overlay sheet to be moved again from second position to said first position.

* * * * *